US005144332A

United States Patent [19]

Okuie

[11] Patent Number: 5,144,332

[45] Date of Patent: Sep. 1, 1992

[54] METHOD OF CONTROLLING HEAD IN IMAGE RECORDING APPARATUS

[75] Inventor: Takayuki Okuie, Ibaraki, Japan

[73] Assignee: Komori Corporation, Tokyo, Japan

[21] Appl. No.: 502,831

[22] Filed: Apr. 2, 1990

[30] Foreign Application Priority Data

Apr. 17, 1989 [JP] Japan ..... 1-95365

[51] Int. Cl.[5] ..... B41J 2/07; B41J 2/215

[52] U.S. Cl. ..... 346/1.1; 346/75; 346/140 R

[58] Field of Search ..... 346/1.1, 140, 75; 310/330

[56] References Cited

U.S. PATENT DOCUMENTS 4,450,375 5/1984 Siegal ..... 310/330
4,628,330 12/1986 Suga et al. ..... 346/75
4,672,397 6/1987 Suga et al. ..... 346/140 R
4,723,131 2/1988 Droit ..... 346/75
4,737,802 4/1988 Mielke ..... 346/140 R
4,792,817 12/1988 Barney ..... 346/140 R

OTHER PUBLICATIONS

Dollenmayer, W. L., "Ink Jet Nozzle Design"; IBM TDB, vol. 22, No. 6, Nov. 1979, pp. 2333-2334.

*Primary Examiner*—Benjamin R. Fuller
*Assistant Examiner*—Alrick Bobb
*Attorney, Agent, or Firm*—Blakely, Sokoloff, Taylor & Zafman

[57] ABSTRACT

According to a method of controlling a head in an image recording apparatus, a valve body made of a diaphragm is brought into tight contact with a valve seat having a nozzle hole. Pressurized ink is supplied to a contact portion between the valve body and the valve seat. A gap formed between the valve body and the valve seat upon supply of the pressurized ink is controlled by an actuator. The pressurized ink is discharged from the nozzle hole through the gap controlled by the actuator.

5 Claims, 5 Drawing Sheets

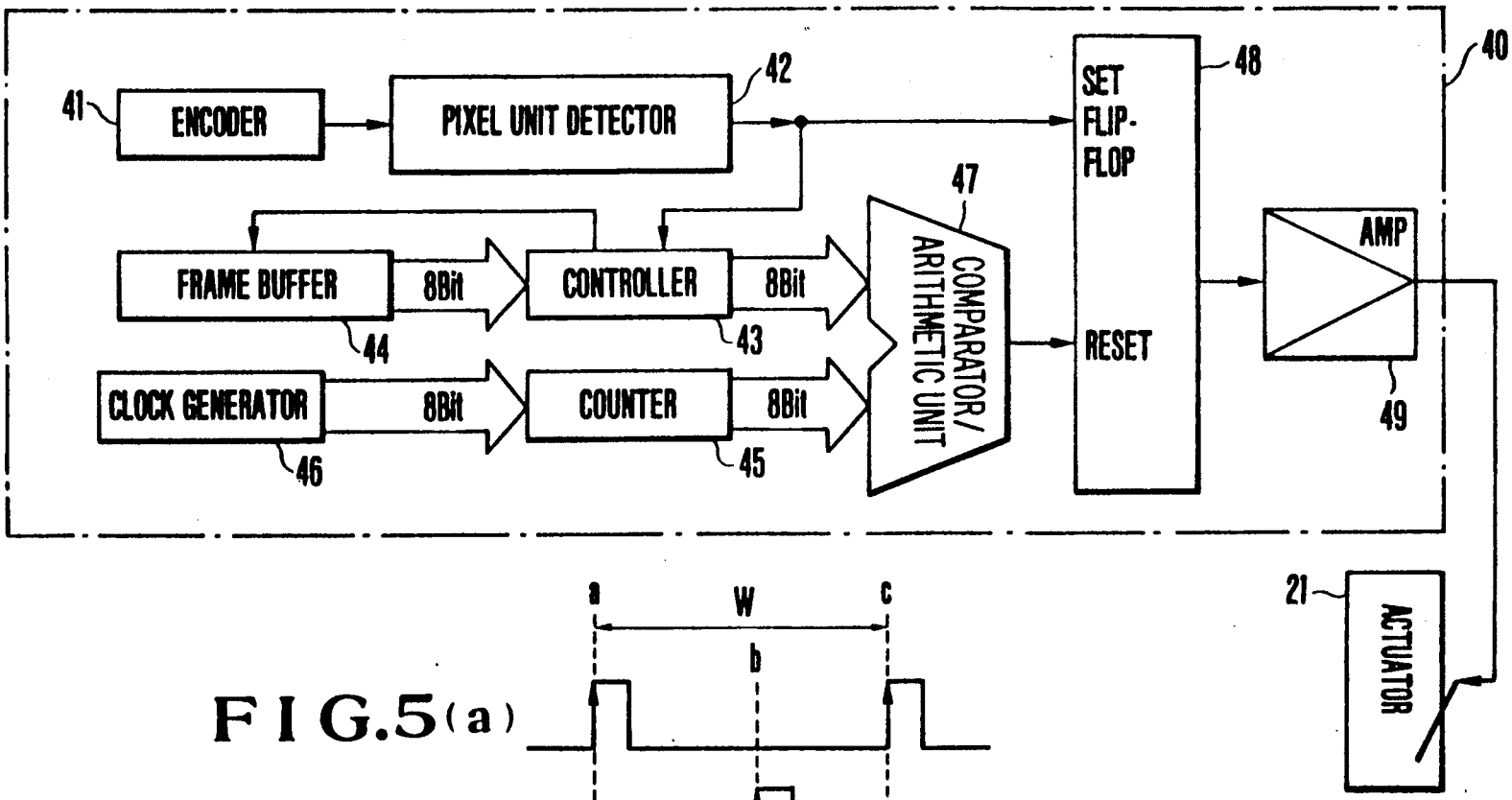
FIG.4
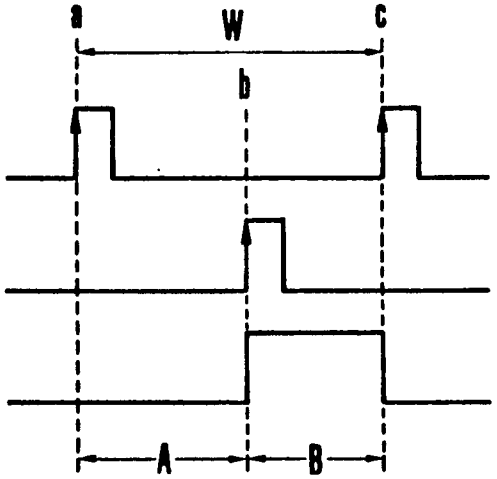
FIG.5(a)
FIG.5(b)
FIG.5(c)

METHOD OF CONTROLLING HEAD IN IMAGE RECORDING APPARATUS

BACKGROUND OF THE INVENTION

The present invention relates to a method of controlling a head in an image recording apparatus for forming an image as a set of pixels as minimum units and recording the pixels on the basis of image information of each pixel, the method performing gradation expressions of each pixel in accordance with a change in a recording area and/or a recording density.

An ink spray type image recording apparatus employing a spray gun type head is known as a conventional image recording apparatus of this type. This image recording apparatus employs a method of controlling a valve mechanism of the spray gun type head to adjust an air flow rate, thereby varying a siphon effect rate to change an ink injection amount (discharge amount). That is, an ink density in the sprayed air is changed to change a density of an ink (i.e., a recording density of a pixel) sprayed onto recording paper or the like, thereby performing gradation expressions.

In the conventional image recording apparatus of this type, however, since its head comprises a siphon type spray gun having a solenoid valve, the unit including the valve body is heavy and is not easy to handle. An operation amount of the head is increased to degrade the response characteristics. In addition, an ink amount is controlled through air as a compressive fluid, and the response characteristics are further degraded. As a result, reproducibility of image information is degraded. The structure of the head is complicated, and complicated adjustment and maintenance require much labor and skills.

SUMMARY OF THE INVENTION

It is an object of the present invention to provide a method of controlling a head in an image recording apparatus, capable of expressing gradation with high response and forming pixels having good reproducibility.

It is another object of the present invention to provide a method of controlling a head in an image recording apparatus, capable of arranging a simple, lightweight, and compact recording apparatus, and facilitating maintenance and adjustment.

In order to achieve the above objects of the present invention, there is provided a method of controlling a head in an image recording apparatus, comprising the steps of bringing a valve body made of a diaphragm into tight contact with a valve seat having a nozzle hole, supplying a pressurized ink to a contact portion between the valve body and the valve seat, controlling a gap formed between the valve body and the valve seat upon supply of the pressurized ink by an actuator, and discharging the pressurized ink from the nozzle hole through the gap controlled by the actuator.

According to the present invention, the gap formed between the valve body and the valve seat upon supply of a compressed ink is controlled to adjust an opening/closing amount or time between the valve body and the valve seat. The opening/closing amount and the time are simultaneously adjusted. Therefore, the recording density of the pixel can be adjusted, or the recording area of the pixel can be adjusted, or both the recording density and area of the pixel can be adjusted, thereby performing gradation expressions with high response.

BRIEF DESCRIPTION OF THE DRAWINGS

FIG. 4 is a block diagram of a drive circuit for controlling an actuator according to another embodiment of the present invention;

FIGS. 5A to 5C are timing timing charts showing signals for explaining the operation of the drive circuit shown in FIG. 4;

DESCRIPTION OF THE PREFERRED EMBODIMENTS

A method of controlling a head in an image recording apparatus according to the present invention will be described in detail hereinafter.

Figure 1:
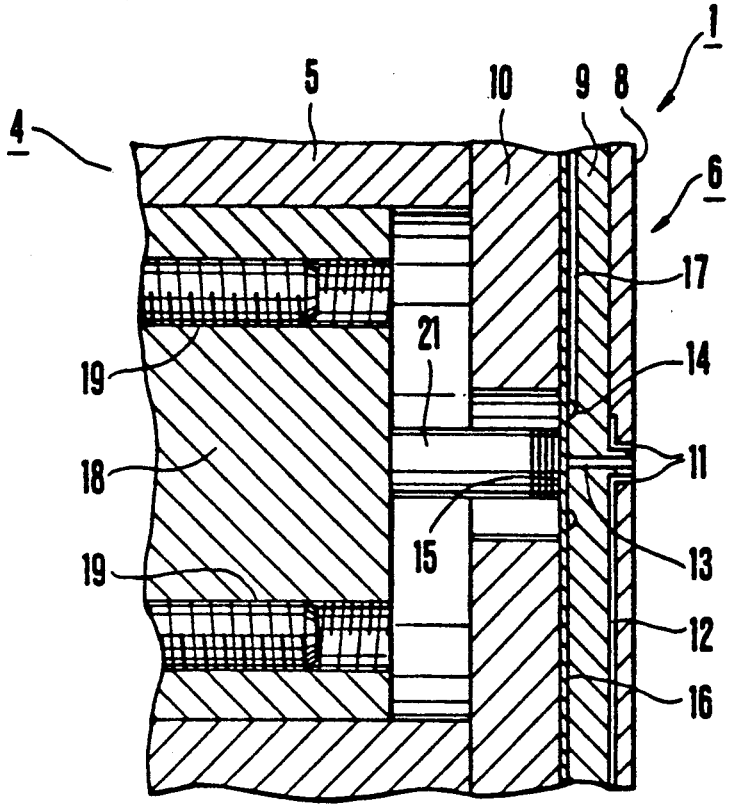
FIG. 1 is a longitudinal sectional view showing a main part of FIG. 2.
Figure 2:
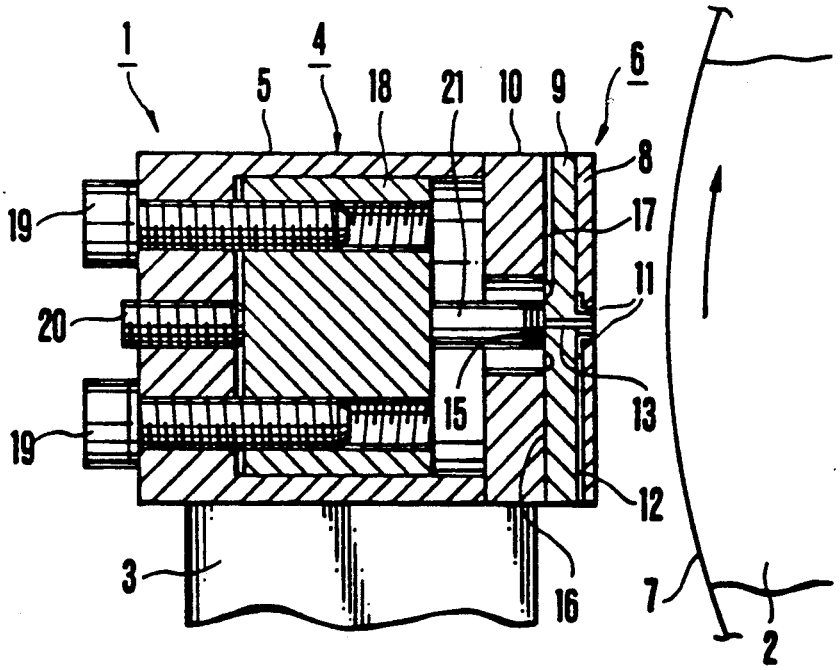
FIG. 2, is a longitudinal sectional view showing an image forming head of an ink spray valve type which employs a method of controlling a head in an image recording apparatus according to an embodiment of the present invention.

FIG. 2 shows an image forming head (i.e., a spray head) of an ink spray valve type which employs a method of controlling a head in an image forming apparatus according to the present invention. FIG. 1 shows the main part of the head shown in FIG. 2.

Referring to FIGS. 1 and 2, a spray head 1 comprises a housing 4 located near a circumferential surface of a rotary cylinder 2 and supported by a support member 3. The support member 3 is reciprocated in the axial direction of the rotary cylinder 2 so as to be interlocked with rotation of the rotary cylinder 2. The housing 4 has a cylindrical shape having two closed ends and comprises a cylindrical body 5 having a bottom and a nozzle head 6 serving as a front bottom plate which closes an open end of the cylindrical body 5. The nozzle head 6 opposes to be spaced apart from a printing surface of, e.g., paper 7 mounted on the rotary cylinder 2 by a predetermined distance. The nozzle head 6 is formed by bonding front, middle, and rear plates 8, 9, and 10 which are divided in a direction of thickness. An air nozzle 11 is formed at the central portion of the front plate 8 such that the open end on the middle plate 9 side has a disc-like opening. The air nozzle 11 is connected to an external air source (not shown) through an air path 12 open to the disc-like opening end and defined between the front and middle plates 8 and 9. An ink nozzle 13 coaxial with the air nozzle 11 is formed at the central portion of the middle plate 9. A circular valve seat 15 surrounded by an annular ink reservoir 14 is formed at an open end of the rear portion of the ink nozzle 13. Reference numeral 16 denotes a valve body made of an elastic thin metal plate (metal diaphragm). The central portion of the valve body 16 is normally in tight contact with the valve seat 15, and the peripheral portion of the valve body 16 is supported and clamped between the middle and the rear plates 9 and 10. The ink nozzle 13 formed in the middle plate 9 is connected to an external pressurized ink tank (not shown) through an ink path 17 formed between contact surfaces of the valve seat 15 and the valve body 16 and between an ink reservoir 14 and the diaphragm and the middle plate 9. The ink in the ink tank is pressurized and is supplied to the valve seat 15 through the ink path 17. The ink supplied to the contact surface of the valve seat 15 through the ink path 17 is then supplied to the ink nozzle 13 through a gap between the valve seat 15 and the valve body 16 which can be opened by an actuator 21 controlled by a drive circuit (to be described in detail later).

A support member 18 is slidably fitted in the hollow portion of the housing 4. Bolts 19 are threadably fitted in the screw holes in the support member 18 through the wall portions of the housing 4, so that the support member 18 can be moved back and forth upon rotation of the bolts 19. Reference numeral 20 denotes a bolt which is threadably engaged with a screw hole formed in the housing 4 to fix the support member 18 after adjustment. The actuator 21 consisting of a piezoelectric element, an operation end of which is integrally fixed with the central portion of the flat surface of the diaphragm 16, is mounted on the central portion of the support member 18 at its end face on the nozzle head 6.

Figure 3:
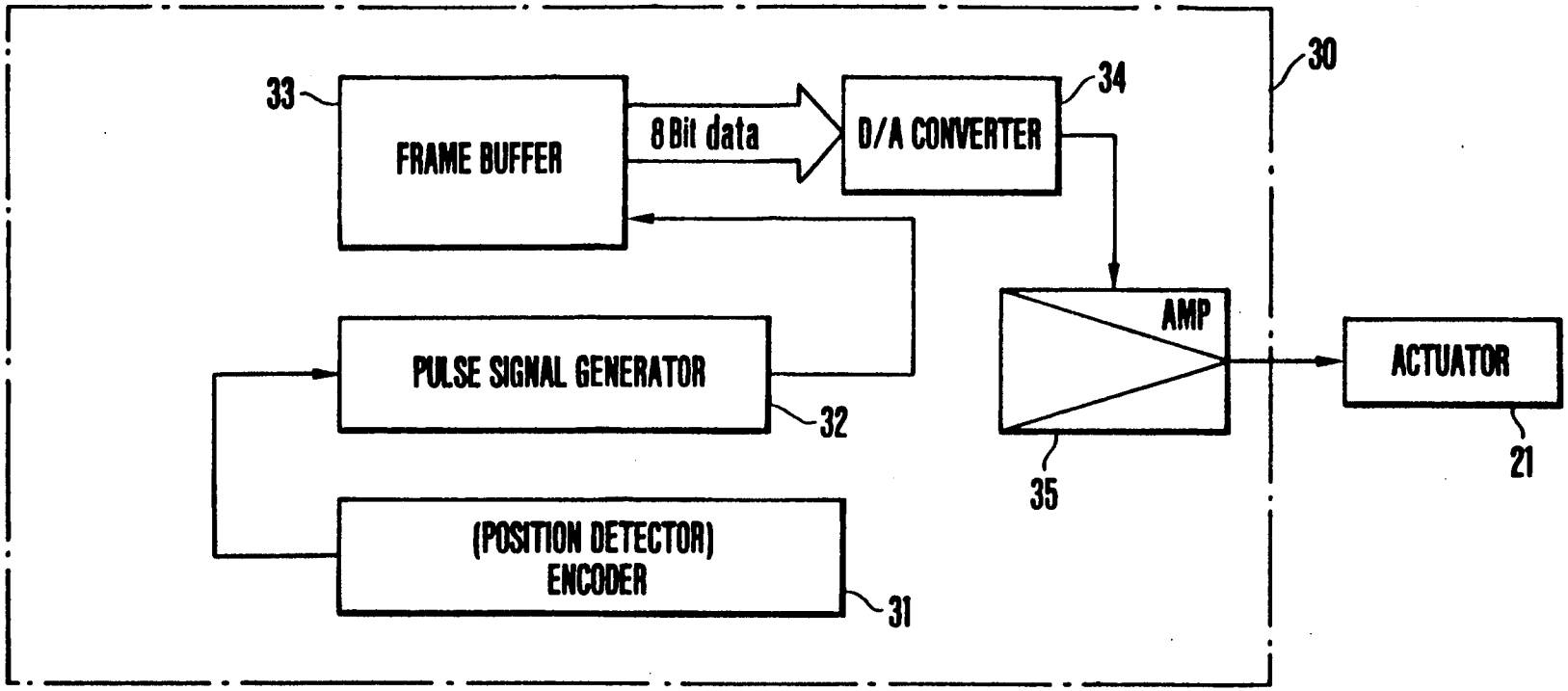
FIG. 3 is a block diagram showing a drive circuit for controlling an actuator in the image forming head shown in FIG. 2.

FIG. 3 is a block diagram showing a drive circuit for controlling the actuator 21 in the spray head 1 arranged as described above. Referring to FIG. 3, reference numeral 31 denotes an encoder (position detector) for generating clock pulses, the number of which corresponds to a displacement position of the spray head 1. Reference numeral 32 denotes a pulse signal generator for generating a pulse signal upon generation of the clock pulse from the encoder 31. This pulse signal has a period determined by a head scanning speed and a pixel size. Reference numeral 33 denotes a frame buffer for receiving a pulse signal generated by the pulse singal generator 32 and reading out image data (gradation data) corresponding to a pixel position detected by the encoder 31 at a leading edge of the pulse signal. Reference numeral 34 denotes a D/A converter for reading out image data read out from the frame buffer 33 into an analog value. Reference numeral 35 denotes an amplifier for receiving the analog value from the D/A converter 34 and supplying a drive signal (voltage signal) having a gain corresponding to the image data value to the actuator 21. More specifically, the image data is read out from the frame buffer 33 in correspondence with a pixel position detected on the basis of the encoder 31, and a voltage signal corresponding to the readout image data is supplied to the actuator 21 through the amplifier 35. An extension amount of the operation end of the actuator 21 is changed in accordance with this voltage signal.

An operation of the spray head 1 having the above arrangement will be described below. When air is supplied from the air source to the nozzle head 6, the air is guided to the air nozzle 11 through the air path 12 and is sprayed from the air nozzle 11. An ink supplied from the pressurized ink tank is supplied to the nozzle head 6, the ink is guided to the contact surfaces of the valve seat 15 and the valve body 16 through the ink path 17 and the ink reservoir 14. When the operation end of the actuator 21 is extended, the gap between the valve body 16 and the valve seat 15 is changed in accordance with an extension amount of the operation end. The pressurized ink is sprayed from the ink nozzle 13 through this gap. The sprayed ink is surrounded by an air flow formed by the air sprayed from the air nozzle 11 and travels straight in a dispersed distribution. The ink is then printed as a clear image on a printing surface of the paper 7. That is, by using the drive circuit shown in FIG. 3, the extension amount of the operation end of the actuator 21 is changed, so that the gap (closing/opening amount) between the valve body 16 and the valve seat 15 is changed. A discharge amount of the ink to the ink nozzle 13 is adjusted. Therefore, gradation expressions in units of pixels can be achieved by adjusting a recording density of the pixel printed on the paper 7.

When the support member 18 is adjusted by the bolts 19 to reciprocate the actuator 21, the gap between the valve body 16 and the valve seat 15 can be adjusted. That is, in order to change an amount of ink passing through the valve seat 15, the bolt 20 is loosened and the bolts 19 are pivoted to reciprocate the actuator 21 together with the support member 18. The open-side limit position of the valve body 16 is changed to adjust the degree of opening of the valve seat 15. The amount of ink passing through the valve seat 15 is adjusted. After the adjustment, this ink amount is kept constant with respect to a value of a voltage applied to the actuator 21. When a reference voltage signal level amplified by the amplifier 35 is changed, zero adjustment and opening adjustment of the valve seat 15 can be performed.

FIG. 4 is a block diaphragm showing a drive circuit for controlling the actuator 21 according to another embodiment of the present invention.

Referring to FIG. 4, reference numeral 41 denotes an encoder for generating a mechanical disassembly position signal corresponding to a displacement position of the spray head 1. Reference numeral 42 denotes a pixel unit detector for receiving the mechanical disassembly position signal generated by the encoder 41 and outputting a pixel unit signal (an "H" level signal shown in FIG. 5A) every recording width (pixel width) as a pixel. Reference numeral 43 denotes a controller for receiving the pixel unit signal sent from the pixel unit detector 42, sending a data request signal to a frame buffer 44 at a leading edge of the pixel unit signal, and reading out image data (gradation data) corresponding to the detected pixel position. Reference numeral 45 denotes a counter for counting a clock signal output from a clock generator 46. Reference numeral 47 denotes a comparator/arithmetic unit for receiving an instantaneous count value from the counter 45 and the image data value read by the controller 43, and comparing the count value with the image data value. The period of the clock signal output from the clock generator 46 is determined as a period obtained such that a one-pixel passing period upon head scanning of the mechanical position is divided by a pixel resolution. When the comparator 47 determines that the count value input from the counter 45 is equal to the image data input from the controller 43, a reset signal is output from the comparator/arithmetic unit 47 to a flip-flop 48. Referring to FIG. 5A, reference symbol W corresponds to a pixel width. A pixel unit signal of "H" level is supplied to the flip-flop 48 as a set signal. When the flip-flop 48 receives the reset signal, it outputs a $\overline{Q}$ output of "H" level to an amplifier 49. A drive signal having a predetermined voltage value is supplied to the actuator 21 through the amplifier 48 on the basis of the $\overline{Q}$ output of "H" level.

At time a in FIG. 5A, when the pixel unit signal of "H" level is input to the flip-flop 48, the flip-flop 48 is held in a set state. A $\overline{Q}$ signal of "L" level is input to the amplifier 49. In this case, no drive signal is supplied to the actuator 21 (time a in FIG. 5C). The actuator 21 is not operated, and the predetermined gap is formed between the valve body 16 and the valve seat 15. The pressurized ink is discharged from the ink nozzle 13 through this gap. Meanwhile, the pixel unit signal of "H" level input to the flip-flop 48 is also input to the controller 43. Image data corresponding to the pixel position is read out from the frame buffer 44 on the basis of the pixel unit signal. The readout image data is set in the comparator/arithmetic unit 47 through the controller 43. The image data value is compared with the instantaneous count value of the counter 45 by the comparator/arithmetic unit 47. When the comparator/arithmetic unit 47 determines that the image data value is equal to the count value, the reset signal is sent to the flip-flop 48 (time b in FIG. 5B). The $\overline{Q}$ output from the flip-flop 48 goes to "H" level, and a drive signal is supplied to the actuator 21 through the amplifier 49 (time b in FIG. 5C). The operation end of the actuator 21 is extended by this drive signal to close the gap formed between the valve body 16 and the valve seat 15. Discharge of the pressurized ink from the ink nozzle 13 is stopped, and the head is ready for generation of the next pixel unit signal (time c in FIG. 5A).

The extension time of the operation end of the actuator 21 is controlled by using the drive circuit shown in FIG. 4. The opening/closing time of the valve body 16 and the valve seat 15 for one pixel is changed (i.e., a valve open time interval A is different form a valve closing time interval B in FIG. 5C). Therefore, an amount of ink discharged to the ink nozzle 13 is adjusted, and the gradation expressions in units of pixels can be achieved by adjusting the recording area of the pixels printed on the paper 7.

Figure 6:
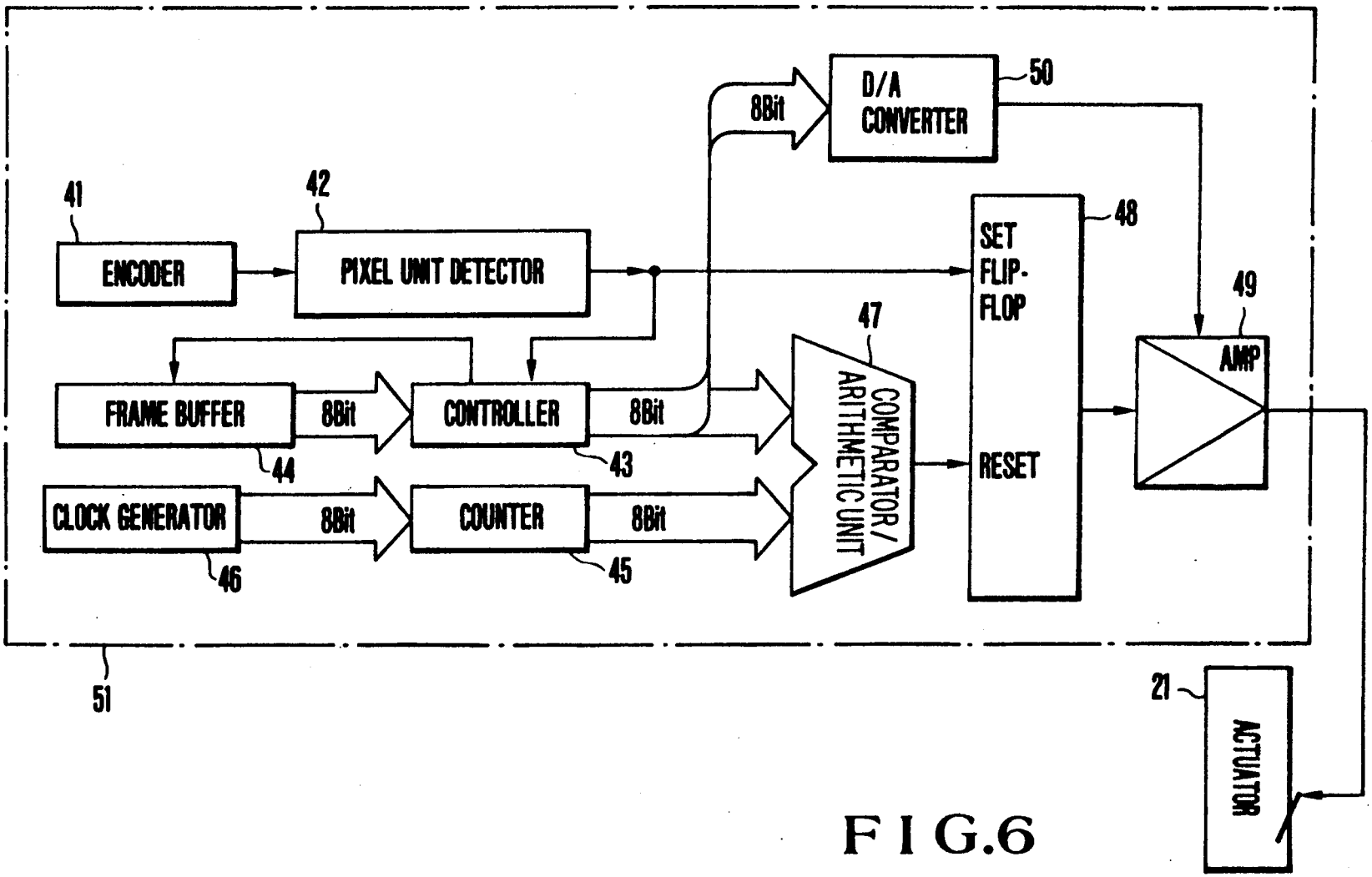
FIG. 6 is a block diagram showing a drive circuit for controlling the actuator according to still another embodiment of the present invention.
Figures 7A, 7B, 7C, 7D:
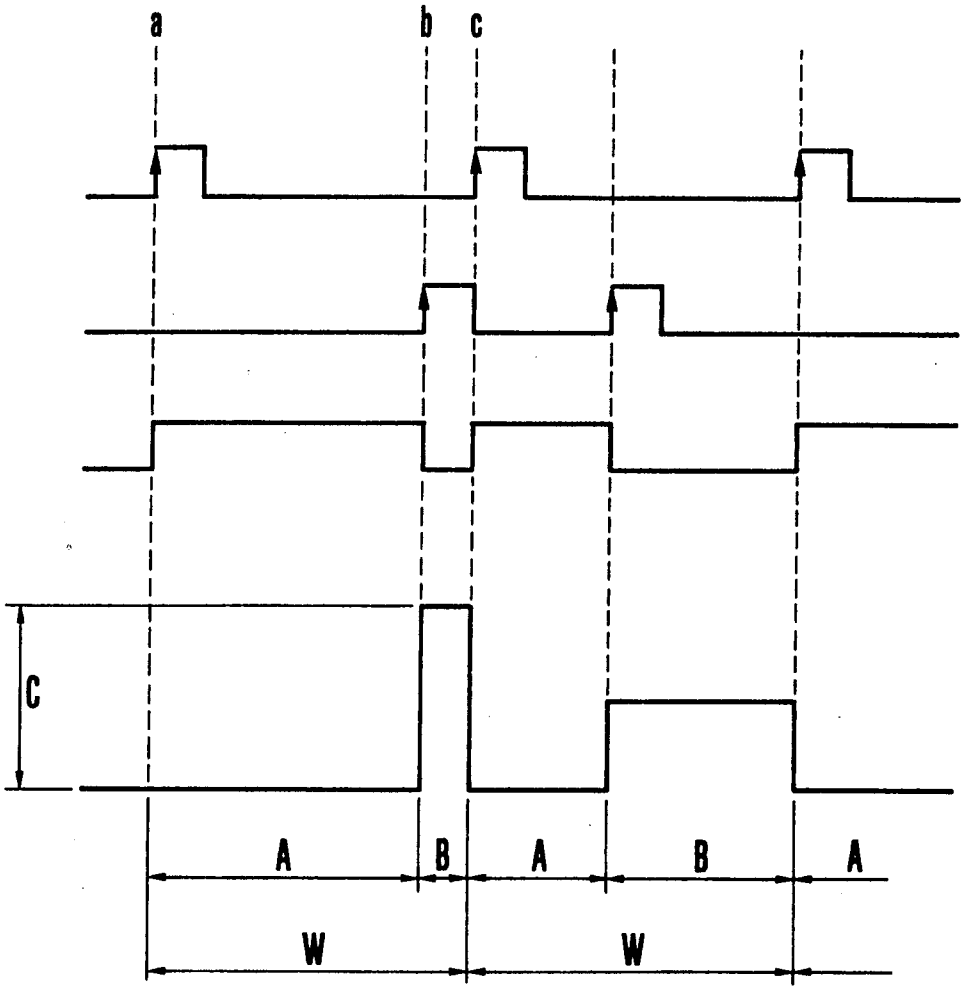
FIGS. 7A to 7D are timing charts showing singals for explaining an operation of the drive circuit shown in FIG. 6.

FIG. 6 is a block diagram of a drive circuit for controlling the actuator 21 according to still another embodiment of the present invention. The same reference numerals as in FIG. 4 denote the same parts, and a detailed description thereof will be omitted. The embodiment of FIG. 6 is different from that of FIG. 4 except that a D/A converter 50 is arranged, and image data is simultaneously input to the D/A converter 50 and a comparator/arithmetic unit 47. More specifically, image data sent from a controller 43 is converted into an analog value by the D/A converter 50. A gain of an amplifier 49 is changed in accordance with the analog image data. With this arrangement, as shown in FIG. 7D, a drive signal supplied to an actuator 21 can be obtained. FIG. 7A shows a pixel unit signal output from a pixel unit detector 42, FIG. 7B shows a reset signal input to a flip-flop 48 through the comparator/arithmetic unit 47, and FIG. 7C shows a $\overline{Q}$ output from the flip-flop 48. The drive signal whose duration and level are changed in accordance with the image data read out by the controller 43 is supplied to the actuator 21. The opening/closing time and the opening/closing amount for each pixel between the valve body 16 and the valve seat 15 are changed. Values A, B, and C corresponding to a valve open time interval, a valve closing interval, and a valve opening degree shown in FIG. 7D are changed to adjust the amount of ink discharged to an ink nozzle 13. Therefore, both the recording area and the recording density of the pixel printed on the paper 7 are simultaneously controlled to perform gradation expressions in units of pixels.

According to each embodiment described above, since the movable portion consisting of a diaphragm made of a lightweight, thin film is the valve body 16, the operation of the actuator 21 can be correctly transmitted to increase the response speed. Since a piezoelectric element is used as the actuator 21, the valve opening/closing operation corresponding to the duration and the level of the drive signal supplied to the actuator 21 can be correctly performed. Adjustment of the discharge ink amount does not depend on an air flow rate, and reproducibility of the image information can be improved. In addition, since the air flow rate can be kept constant, the ink spray width of the ink can be stabilized, and the arrangement can be made simple, so that a lightweight, compact head can be obtained to facilitate maintenance and adjustment. The diaphragm 16 has a short stroke, wear and fatigue of the diaphragm 16 can be minimized to improve durability.

During zero gradation operation, the valve body 16 and the valve seat 15 can be perfectly closed to each other, and contamination caused by ink leakage can be prevented. Therefore, image quality can be improved.

The number of gradation levels as a product of resolutions of the D/A converter 50 and the clock generator 46 can be obtained by valve opening/closing amount control and valve opening/closing time control when the drive circuit shown in FIG. 6 is used, and therefore the image quality can be greatly improved. When the number of gradation levels is limited, the resolutions of the D/A converter and the clock generator can be reduced. The cost of the drive circuit can be reduced while image quality can be improved.

In the above embodiments, a piezoelectric element is exemplified as the actuator 21, but the present invention is not limited to this.

According to a method of controlling a head in an image recording apparatus of the present invention, as has been described above, a valve body comprising a diaphragm is arranged in tight contact with a valve body having a nozzle hole, and a pressurized ink is supplied to contact surfaces of the valve body and the valve seat. A gap formed between the valve body and the valve seat upon supply of the pressurized ink is controlled by an actuator. The pressurized ink is discharged from the nozzle hole through the controlled gap. In this manner, since the gap formed between the valve body and the valve seat upon supply of the pressurized ink is controlled to control an opening/closing amount or time between the valve body and the valve seat or both the opening/closing amount and time between the valve body and the valve seat, thereby adjusting the recording density or area of the pixels or both the recording density and area thereof. The gradation expressions can be performed with high response, and pixels having good reproducibility can be formed. That is, since the valve body is made of a diaphragm of a thin film, the operation of the actuator can be correctly transmitted to obtain a higher response. At the same time, the apparatus can be made compact and lightweight to facilitate maintenance and adjustment, thereby improving maintainability.

What is claimed is:

1. A method of controlling a head in an image recording apparatus, comprising the steps of:

bringing a valve body made of a diaphragm into tight contact with a valve seat having an ink nozzle;

supplying pressurized ink to a contact portion between said valve body and said valve seat;

controlling a gap formed between said valve body and said valve seat upon supply of the pressurized ink by an actuator fixed to said valve body; and discharging the pressurized ink from said ink nozzle through the gap controlled by said actuator, the pressurized ink discharged from said ink nozzle being surrounded by air flow sprayed from an air nozzle, wherein an outlet of said air nozzle from which air is ejected and an outlet of said ink nozzle from which ink is ejected both lie in a single plane, whereby said air flow is formed around said ink nozzle such that the pressurized ink travels straight due to the air flow.

2. A method of controlling a head in an image recording apparatus, comprising the steps of:

bringing a valve body made of a diaphragm into tight contact with a valve seat having an ink nozzle;

supplying pressurized ink to a contact portion between said valve body and said valve seat;

controlling a gap formed between said valve body and said valve seat upon supply of the pressurized ink by an actuator fixed to said valve body; and discharging the pressurized ink from said ink nozzle through the gap controlled by said actuator, the pressurized ink discharged from said ink nozzle being surrounded by air flow sprayed from an air nozzle, which is formed around said ink nozzle such that the pressurized ink travels straight due to the air flow.

wherein the step of controlling the gap comprises the step of changing an opening/closing time between said valve body and said valve seat for each pixel to adjust an ink discharge amount, thereby controlling a recording area of the pixel.

3. A method of controlling a head in an image recording apparatus, comprising the steps of;

bringing a valve body made of a diaphragm into tight contact with a valve seat having an ink nozzle;

supplying pressurized ink to a contact portion between said valve body and said valve seat;

controlling a gap formed between said valve body and said valve seat upon supply of the pressurized ink by an actuator fixed to said valve body; and discharging the pressurized ink from said ink nozzle through the gap controlled by said actuator, the pressurized ink discharged from said ink nozzle being surrounded by air flow sprayed from an air nozzle, which is formed around said ink nozzle such that the pressurized ink travels straight due to the air flow, wherein the step of controlling the gap comprises the step of changing an opening/closing amount between said valve body and said valve seat for each pixel to adjust an ink discharge amount, thereby controlling a recording density of the pixel.

4. A method of controlling a head in an image recording apparatus, comprising the steps of;

bringing a valve body made of a diaphragm into tight contact with a valve seat having an ink nozzle;

supplying pressurized ink to a contact portion between said valve body and said valve seat;

controlling a gap formed between said valve body and said valve seat upon supply of the pressurized ink by an actuator fixed to said valve body; and discharging the pressurized ink from said ink nozzle through the gap controlled by said actuator, the pressurized ink discharged from said ink nozzle being surrounded by air flow sprayed from an air nozzle, which is formed around said ink nozzle such that the pressurized ink travels straight due to the air flow, wherein the step of controlling the gap comprises the step of simultaneously changing an opening/closing time and an opening/closing amount between said valve body and said valve seat for each pixel to adjust an ink discharge amount, thereby controlling both a recording area and a recording density of the pixel.

5. A method according to claim 1, wherein said actuator comprises a piezoelectric element.

* * * * *